US008336874B2

(12) United States Patent
Kato et al.

(10) Patent No.: US 8,336,874 B2
(45) Date of Patent: Dec. 25, 2012

(54) SOLENOID DEVICE, AUTOMATIC DOCUMENT FEEDER, AND IMAGE FORMING APPARATUS

(75) Inventors: Chisa Kato, Aichi (JP); Kenji Hari, Aichi (JP); Toshihisa Takada, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 825 days.

(21) Appl. No.: 12/314,653

(22) Filed: Dec. 15, 2008

(65) Prior Publication Data

US 2009/0152792 A1 Jun. 18, 2009

(30) Foreign Application Priority Data

Dec. 18, 2007 (JP) ..... 2007-326491

(51) Int. Cl.
*B65H 3/06* (2006.01)

(52) U.S. Cl. ..... 271/117; 361/160

(58) Field of Classification Search ..... 271/114, 271/117, 118, 303–305, 264; 361/160
See application file for complete search history.

(56) References Cited

U.S. PATENT DOCUMENTS

| | | | | |
|---|---|---|---|---|
| 4,572,135 | A * | 2/1986 | Nakajima et al. | 123/678 |
| 5,462,267 | A * | 10/1995 | Hori | 271/10.04 |
| 6,354,253 | B1 * | 3/2002 | Katsumata et al. | 123/90.11 |
| 2004/0240140 | A1 * | 12/2004 | Maller et al. | 361/142 |
| 2009/0066474 | A1 | 3/2009 | Kawachi et al. | |

FOREIGN PATENT DOCUMENTS

| | | |
|---|---|---|
| JP | 9-325556 | 12/1997 |
| JP | 10-139179 | 5/1998 |
| JP | 3561679 | 6/2004 |
| JP | 2007-326491 | 12/2007 |

OTHER PUBLICATIONS

English translation of Japanese Publication No. 9-325556.*
Abstract of Japanese Publication No. JP 2002-023635.
Notice of Rejection for corresponding Japanese patent application No. 2007-326491 dated Apr. 17, 2012.

* cited by examiner

*Primary Examiner* — Gerald McClain
*Assistant Examiner* — Thomas Morrison
(74) *Attorney, Agent, or Firm* — Harness, Dickey & Pierce, P.L.C.

(57) ABSTRACT

A solenoid device including a plunger, a solenoid configured to cause a displacement of the plunger, and a driving control unit configured to control driving of the solenoid. The driving control unit supplies current pulses to the solenoid and changes a pulse interval of the current pulses.

6 Claims, 14 Drawing Sheets

SOLENOID DEVICE, AUTOMATIC DOCUMENT FEEDER, AND IMAGE FORMING APPARATUS

BACKGROUND OF THE INVENTION

1. Field of the Invention

The present invention relates to a solenoid device having a plunger and a solenoid to displace the plunger, an automatic document feeder having the solenoid device configured to move a member capable of transferring or guiding a document, and an image forming apparatus having the automatic document feeder.

2. Description of the Related Art

Patent Document 1 discloses a solenoid device having a plunger biased toward a maximum extension position (position that the plunger extends furthest from a solenoid side) by a coil spring and a solenoid which displaces the plunger. When the plunger attracted in the solenoid is repelled back to the maximum extension position, a time to supply current pulses to the solenoid is shortened so that a displacement speed of the plunger is reduced, instead of suddenly stopping a current supply to the solenoid. In this manner, an impact noise made when the plunger is repelled back to the maximum extension position is reduced.

Patent Document 2 discloses a solenoid device having a plunger biased toward a maximum extension position by a coil spring and a solenoid which displaces the plunger. When displacing the plunger by supplying a current to the solenoid, the current is supplied to the solenoid plural times. In this manner, an impact noise made when the plunger is attracted to a maximum attraction position (position where the plunger is attracted closest to the solenoid) is reduced.

[Patent Document 1] Japanese Patent Application Publication No. 10-139179

[Patent Document 2] Japanese Patent No. 3561679

In the technique disclosed in Patent Document 1, however, an electric circuit control element such as a pulsed current supply driver is used to control the current supply. Therefore, a circuit device may become complicated and the manufacturing cost may be increased. In the technique disclosed in Patent Document 2, the impact noise cannot be sufficiently reduced if an operation environment changes in such a manner that an attraction force of the solenoid decreases due to a raised temperature of the solenoid, or a mechanical load on the plunger varies.

SUMMARY OF THE INVENTION

In view of the aforementioned circumstances, it is an object of at least one embodiment of the invention to provide a solenoid device having a simple structure at lower cost, which is capable of sufficiently reducing an impact noise even when an operation environment changes, a mechanical load varies, or the like, and to provide an automatic document feeder having this solenoid device and an image forming apparatus having this automatic document feeder.

According to one aspect of the invention, a solenoid device including a plunger, a solenoid configured to cause a displacement of the plunger, and a driving control unit configured to control driving of the solenoid. The driving control unit supplies current pulses to the solenoid and changes a pulse interval of the current pulses.

According to another aspect of the invention, an automatic document feeder includes a solenoid device having a plunger, a solenoid configured to cause a displacement of the plunger, a driving control unit configured to control driving of the solenoid by supplying a current pulses to the solenoid and changing a pulse interval of the current pulses, and a moving member connected to the plunger of the solenoid device. The moving member transfers or guides a document; and the moving member contacts or is separated from the document by the displacement of the plunger.

According to another aspect of the invention, an image forming apparatus includes the automatic document feeder. An image on the document transferred by the automatic document feeder is formed on a recording medium.

According to at least one embodiment, by supplying current pulses to the solenoid and changing a pulse interval of the current pulses, an impact noise made by the displacement of the plunger can be sufficiently reduced without providing an electric circuit control element and the like such as a pulsed current supply driver. Therefore, the impact noise made by the displacement of the plunger can be sufficiently reduced with a simple structure at lower cost. Further, for example, by appropriately changing a change rate of the interval of the current pulses supplied to the solenoid, an impact noise made by the displacement of the plunger can be sufficiently reduced even when an operation environment changes or a mechanical load on the plunger varies.

DETAILED DESCRIPTION OF THE PREFERRED EMBODIMENTS

Figure 8:
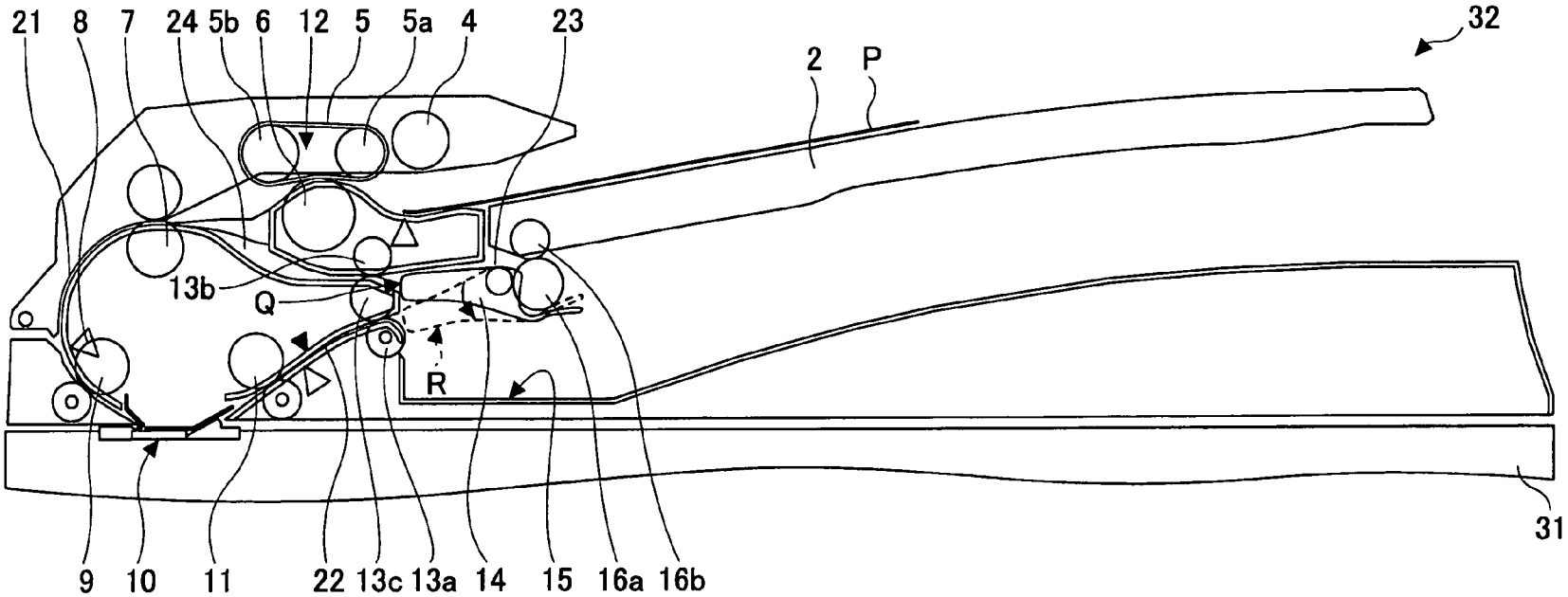
FIG. 8 is a vertical cross-sectional view showing a schematic structure of an automatic document feeder of the first embodiment.

A first embodiment of the present invention is hereinafter described in detail with reference to the drawings. A solenoid device 1 of this embodiment is provided in an automatic document feeder 32. As shown in FIG. 8, the automatic document feeder 32 has a document stack stage 2 on which a bundle of documents P are inserted and set. On the downstream side of the document stack stage 2, there are provided a pick-up roller 4 capable of sending out the bundle of documents P set on the document stack stage 2 to the downstream side, and a separation paper feeder unit 12 capable of separating and feeding the documents one by one. On the downstream side of the separation paper feeder unit 12, there is provided a first transfer path 21 capable of transferring the document P fed by the separation paper feeder unit 12 to an image read unit 10. On the downstream side of the image read unit 10, there is provided a second transfer path 22 capable of transferring the document P which came through the image read unit 10 to the downstream side. On the downstream side of the second transfer path 22, there are provided a paper output unit 15 on which the documents P transferred through the second transfer path 22 are stacked, a third transfer path 23 capable of switching-back the document P which came through the second transfer path 22, and a switching claw 14 capable of switching a destination of the document P which came through the second transfer path 22 to the paper output unit 15 or the third transfer path 23. On the downstream side of the third transfer path 23, there is provided a fourth transfer path 24 capable of returning the document P which has been switched-back by the third transfer path 23 into the first transfer path 21. Note that the switching claw 14 is pivotably mounted between a document output position Q to guide the document P to the paper output unit 15 and a document inversion position R to guide the document P to the third transfer path 23.

In the first transfer path 21, there are provided a pair of transfer rollers 7 and a pair of transfer rollers 9 which are capable of transferring the document P to the downstream side. On a slightly upstream side of the pair of transfer rollers 9, a resist sensor 8 capable of sensing the document P is provided. In the second transfer path 22, a pair of transfer rollers 11 and a pair of transfer rollers 13*c* and 13*a* which are capable of transferring the document P to the downstream side are provided. In the third transfer path 23, a pair of reversible inversion rollers 16*a* and 16*b* is provided. In the fourth transfer path 24, a pair of transfer rollers 13*c* and 13*b* capable of transferring the switched-back document P to the downstream is provided.

Figure 9:
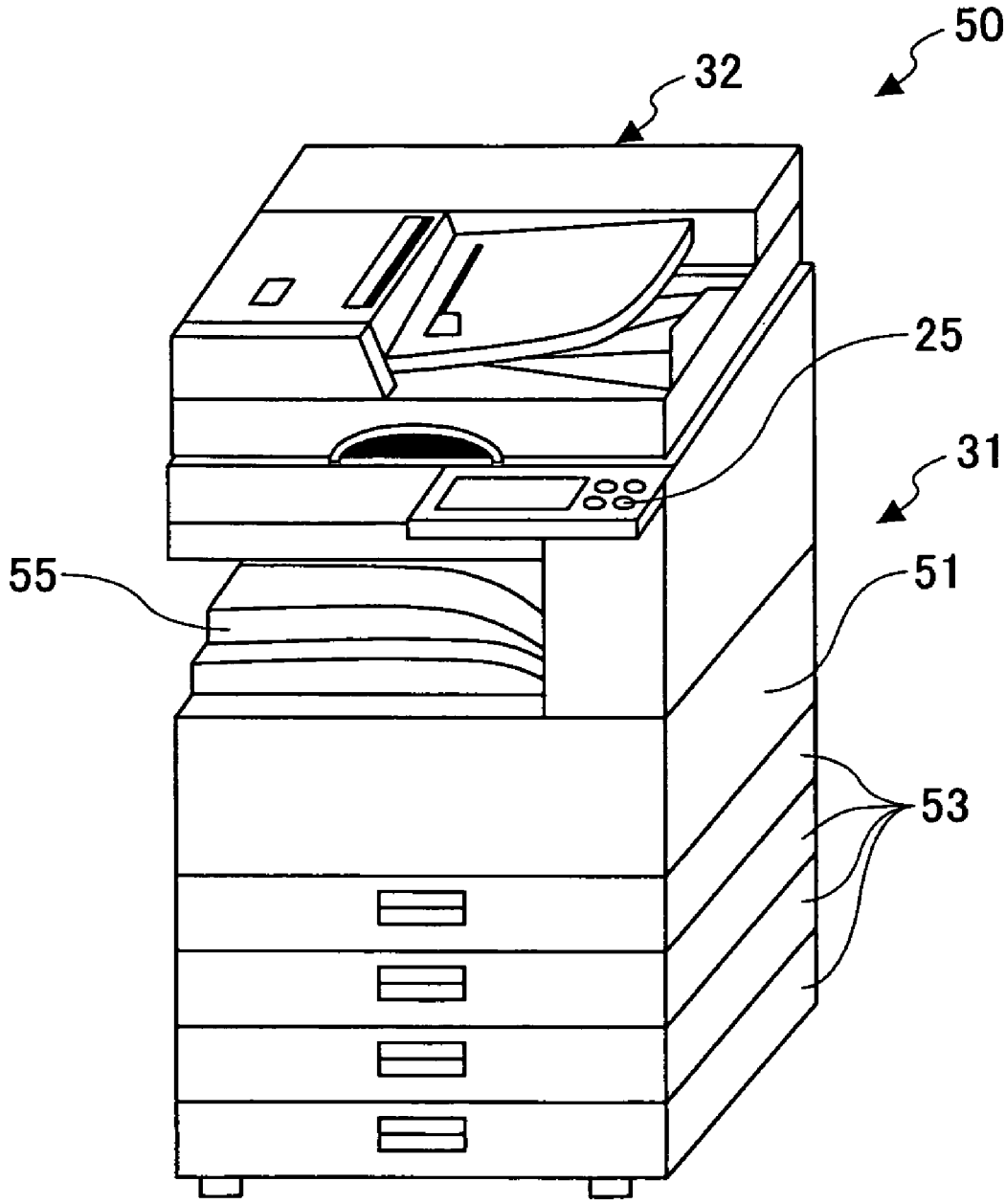
FIG. 9 is a perpendicular view of an image forming apparatus of the first embodiment.

As shown in FIG. 9, the automatic document feeder 32 is provided on an upper side of the image forming apparatus body 31 so to be capable of opening and closing with a hinge. An image forming apparatus 50 is a multifunction peripheral including an image forming unit 51 capable of forming an image on the document P which is read by the image read unit 10 onto a recording medium (paper), paper feed trays 53 capable of supplying the recording medium to the image forming unit 51, and a paper output tray 55 capable of outputting the recording medium on which the image is formed by the image forming unit 51.

The solenoid device 1 controls a displacement speed that the pick-up roller 4 in the automatic document feeder 32 moves up and down by controlling driving of the solenoid 43.

Figure 7:
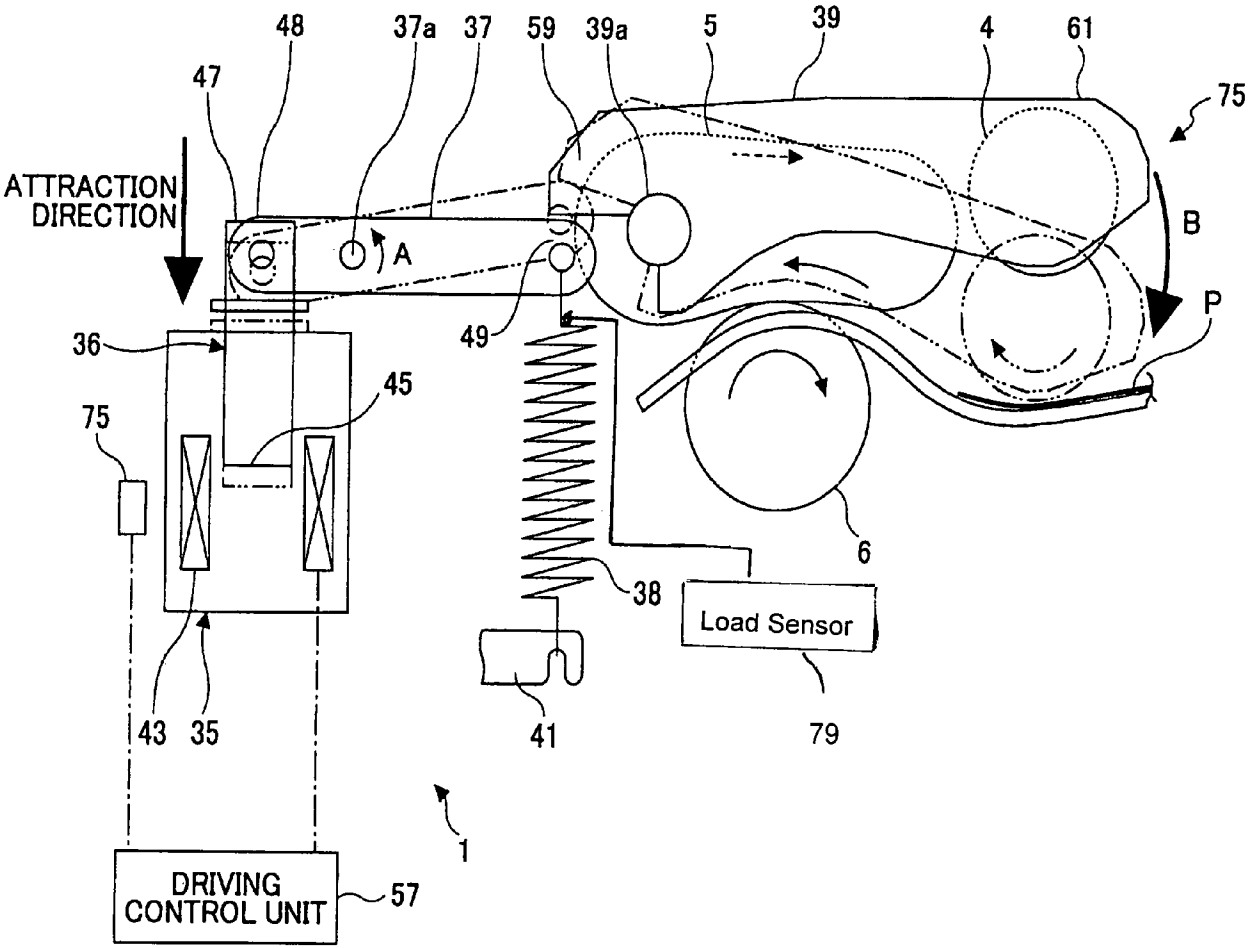
FIG. 7 is a vertical cross-sectional view showing a schematic structure of the solenoid device of the first embodiment.

As shown in FIG. 7, the solenoid device 1 includes a plunger 36, the solenoid 43 capable of displacing the plunger 36, and a driving control unit 57 capable of controlling the driving of the solenoid 43.

One end 45 of the plunger 36 is placed in the solenoid 43 incorporated in a solenoid unit 35. An opposite end 47 of the plunger 36 is pivoted at one end 48 of a connection member 37.

The connection member 37 is pivotably mounted at a support point 37*a*. One end of a coil spring 38 is connected to an opposite end 49 of the connection member 37.

An opposite end of the coil spring 38 is connected to a hook 41. Note that the hook 41 is fixed at a housing of the automatic document feeder 32.

On an upper side of the opposite end 49 of the connection member 37, one end of a holding member 39 holding the pick-up roller 4 is located. When the connection member 37 moves in a direction of an arrow A, the opposite end 49 of the connection member 37 contacts one end 59 of the holding member 39.

The holding member 39 is pivotably mounted at a support point 39*a*. The pick-up roller 4 is pivoted at an opposite end 61 of the holding member 39.

A voltage sensor 75 is provided on a solenoid unit 35 side so that a voltage applied to the solenoid 43 can be sensed.

A driving control unit 57 changes an interval t of current pulses (pulse interval) supplied to the solenoid 43 to control driving of the solenoid 43. It is to be noted that the pulse interval t corresponds to an OFF time of the current pulses. Hereinafter, a configuration of the driving control unit 57 is described with reference to FIG. 4. The driving control unit 57 includes an interval table storage unit 63 capable of storing plural interval tables 62 shown in Chart 1; an interval table selection unit 65 capable of selecting the optimal interval table 62 from the interval table storage unit 63 upon receiving a signal from an operation unit 73 and the voltage sensor 75 in the image forming apparatus body 31; an interval table execution unit 67 which includes a timer 69 and is capable of executing the selected interval table 62; and a sending unit 71 capable of sending a signal from the interval table selection unit 65 and the interval table execution unit 67 to the solenoid 43. Note that the interval tables 62 include data of changes of the pulse interval t set in advance, to deal with changes of the operation environment of the solenoid or a mechanical load on the plunger 36.

CHART 1

| Table No. | ON time 1 | OFF time 1 | ON time 2 | OFF time 2 | ON time 3 | OFF time 3 | ... | ON time N | OFF time N |
|---|---|---|---|---|---|---|---|---|---|
| a | Taon1 | Taoff1 | Taon2 | Taoff2 | Taon3 | Taoff3 | ... | TaonN | TaoffN |
| b | Tbon1 | Tboff1 | Tbon2 | Tboff2 | Tbon3 | Tboff3 | ... | TbonN | TboffN |
| c | Tcon1 | Tcoff1 | Tcon2 | Tcoff2 | Tcon3 | Tcoff3 | ... | TconN | TcoffN |
| . | | | | | | | ... | | |
| . | | | | | | | | | |
| . | | | | | | | | | |

Chart 1 shows a group of the interval tables 62 in the case where the plunger 36 is attracted to the solenoid 43 side. In the interval tables a, b, and c, the pulse intervals t (OFF time of the current pulse) become gradually shorter as time passes. A rate that the pulse interval t becomes shorter is larger in the order of the interval tables a, b, and c.

In the interval tables 62 in the case where the plunger 36 extends from the solenoid 43 side, the pulse interval t (OFF time of the current pulse) becomes gradually longer as time passes. A rate that the pulse interval t becomes longer is larger in the order of the interval tables a, b, and c.

Figure 6:
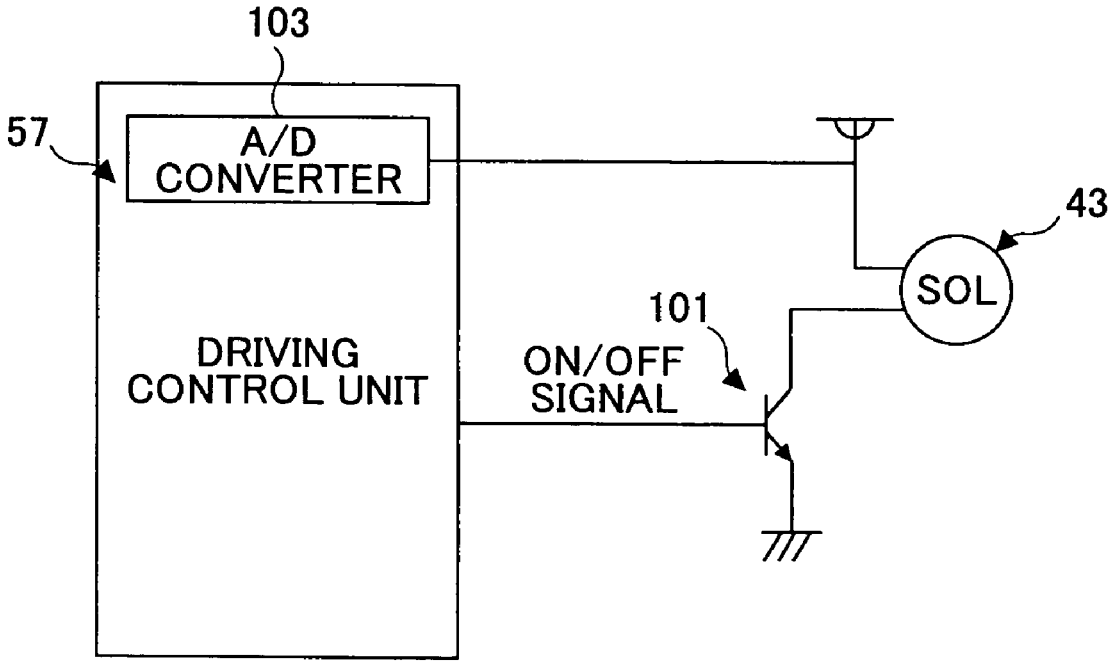
FIG. 6 is a block diagram showing a communication state between the driving control unit of the solenoid device of the first embodiment and a solenoid.

As shown in FIG. 6, a base terminal of a transistor 101 is connected to the driving control unit 57. A collector terminal of the transistor 101 is connected to the solenoid 43 so that an ON/OFF signal is sent from the driving control unit 57 to the solenoid 43. Further, the driving control unit 57 includes an A/D converter 103 capable of converting analog data of a voltage value applied to the solenoid 43 into digital data.

Hereinafter, operations of the automatic document feeder 32 and the image forming apparatus 50 of this embodiment are described with reference to FIGS. 8 and 9. The pick-up roller 4 is descended in response to a paper feed start signal from the operation unit 73 of the image forming apparatus body 31 and pressed to contact the document P. The documents P are sent from the top by the rotation of the pick-up roller 4 to a separation paper feeder unit 12 formed of a paper feed belt 5 and a separation roller 6. Only a top sheet of the documents P is separated and sent by the separation paper feeder unit 12. The separated document P is then transferred to the first transfer path 21 having the pair of transfer rollers 7 and the pair of transfer rollers 9. Note that the paper feed belt 5 is provided around rollers 5*a* and 5*b* as shown in FIG. 8.

When only a first image surface is to be read (single side mode), image data of the document P is read by the image read unit 10 and then the document P is guided to the switching claw 14 in the document output position Q through the second transfer path 22 including the pair of transfer rollers 11 and the pair of transfer rollers 13*c* and 13*a*, and outputted to an output unit 15. It is to be noted that an upper limit (document output position Q) and a lower limit (document inversion position R) of the switching claw 14 are set by a stopper which is provided so as not to disturb the transfer of the document.

When both sides of the document P are to be read (double side mode), the document P sent from the separation paper feeder unit 12 passes through the first transfer path 21 so that the first image surface is read by the image read unit 10. After the first image surface is read, the document P passes through the second transfer path 22 and is guided to the switching claw 14 which is in the document inversion position R to perform a switching-back. Then, the document P is sent to the third transfer path 23.

A timing to determine a rotation direction of the pair of inversion rollers 16*a* and 16*b* and the switching claw 14 is determined depending on the single sided mode or the double sided mode, by sensing a leading edge of the document P by the resist sensor 6.

The document P sent to the third transfer path 23 is then transferred a certain distance so that its rear end is separated from the pair of transfer rollers 13*c* and 13*a*, and the pair of inversion rollers 16*a* and 16*b* can hold the document P. Then, the document P is switched-back by a reverse rotation of the pair of inversion rollers 16*a* and 16*b* and transferred to the fourth transfer path 24.

By the rotation of the pair of transfer rollers 13*c* and 13*b*, the document P passes through the fourth transfer path 24 and the first transfer path 21, and then a second image surface is read by the image read unit 10.

When the document P is to be outputted after the second image surface is read, the document P is transferred through the second transfer path 22 to the paper output unit 15. When the document P is inverted again for adjusting a page order, the document P is transferred through the third transfer path 23 by the switching claw 14 to the fourth transfer path 24 after a switching-back.

A rotation direction of the inversion roller 11 and the switching claw 14 is determined depending on whether the document P is outputted as it is or inverted again by sensing a leading edge of the document P by the resist sensor 6. When the document P is inverted again, the document P is outputted to the paper output unit 15 through the fourth transfer path 24, the first transfer path 21, and the second transfer path 22.

On the other hand, a recording medium (paper) is supplied from one of the paper feed trays 53 of the image forming apparatus body 31 to the image forming unit 51. In the image forming unit 51, the image of the document P read by the image read unit 10 is formed on the recording medium. The recording medium on which the image is formed is then outputted to the paper output tray 55.

Figure 4:
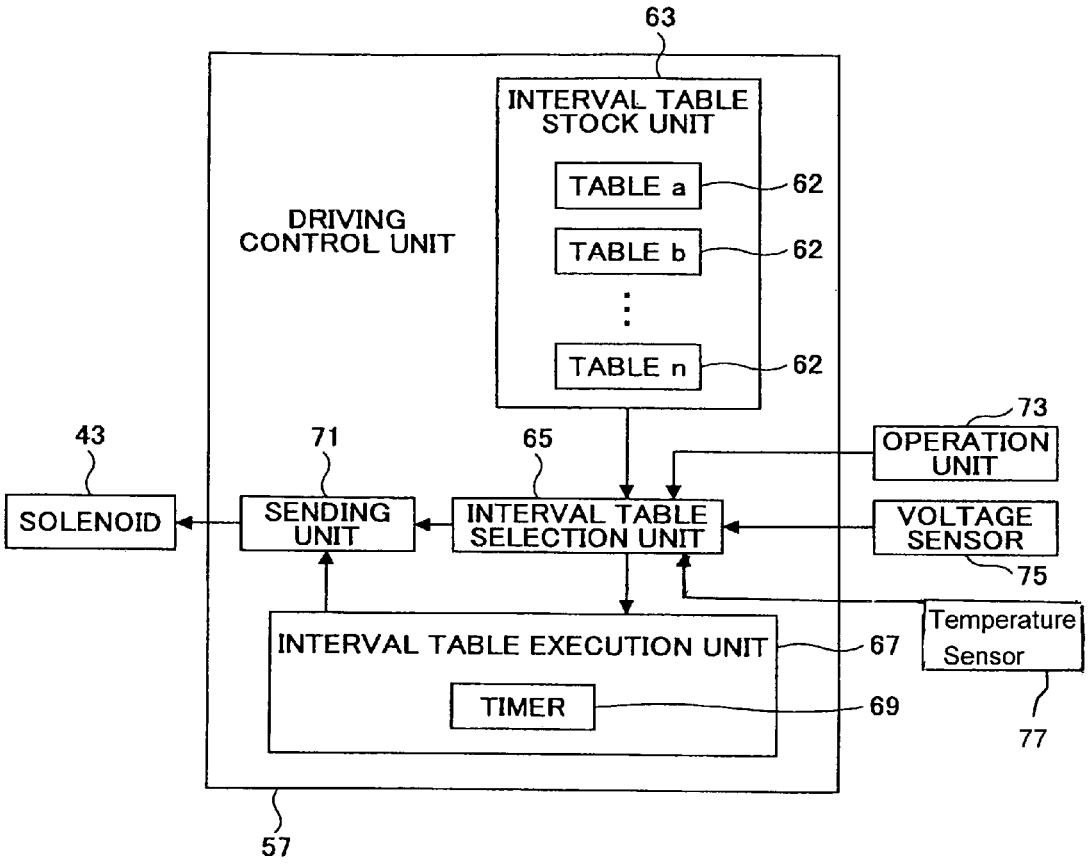
FIG. 4 is a block diagram showing a configuration of a driving control unit of the solenoid device of the first embodiment.

Next, an operation of the solenoid device 1 is described in detail with reference to FIGS. 4, 6, and 7. When an ON signal is inputted from a sending unit 71 of a driving control unit 57 to the transistor 101 upon receiving the paper feed start signal from the operation unit 73 of the image forming apparatus body 31, a current is supplied to the solenoid 43. When the current is supplied to the solenoid 43, the plunger 36 is attracted in the solenoid 43, with an attraction force of the solenoid 43 resisting an elastic force of the coil spring 38. At this time, when the connection member 37 rotates in a direction of an arrow A (counterclockwise), the opposite end 49 of the connection member 37 contacts one end 59 of the holding member 39, thereby the holding member 39 is rotated in a direction of an arrow B (clockwise). By this operation, the pick-up roller 4 is descended and contacts the document P.

When an OFF signal is inputted from the sending unit 71 to the transistor 101, on the other hand, the current which has been supplied to the solenoid 43 is blocked. As a result, the plunger 36 extends from the solenoid 43 side, which rotates the connection member 37 in a reverse direction to the arrow A and shrinks the coil spring 38. By this operation, the holding member 39 rotates in a reverse direction to the arrow B, the pick-up roller 4 is ascended, and the document P and the pick-up roller 4 are separated.

In general, when the plunger is attracted to the solenoid side and when the plunger extends from the solenoid side, an impact noise is generated since the solenoid and the plunger, the plunger and the connecting member, the connecting member and the coil spring, the connecting member, the pick-up roller, and the holding member, and the like rapidly hit each other. This leads to a noise problem.

Figure 5:
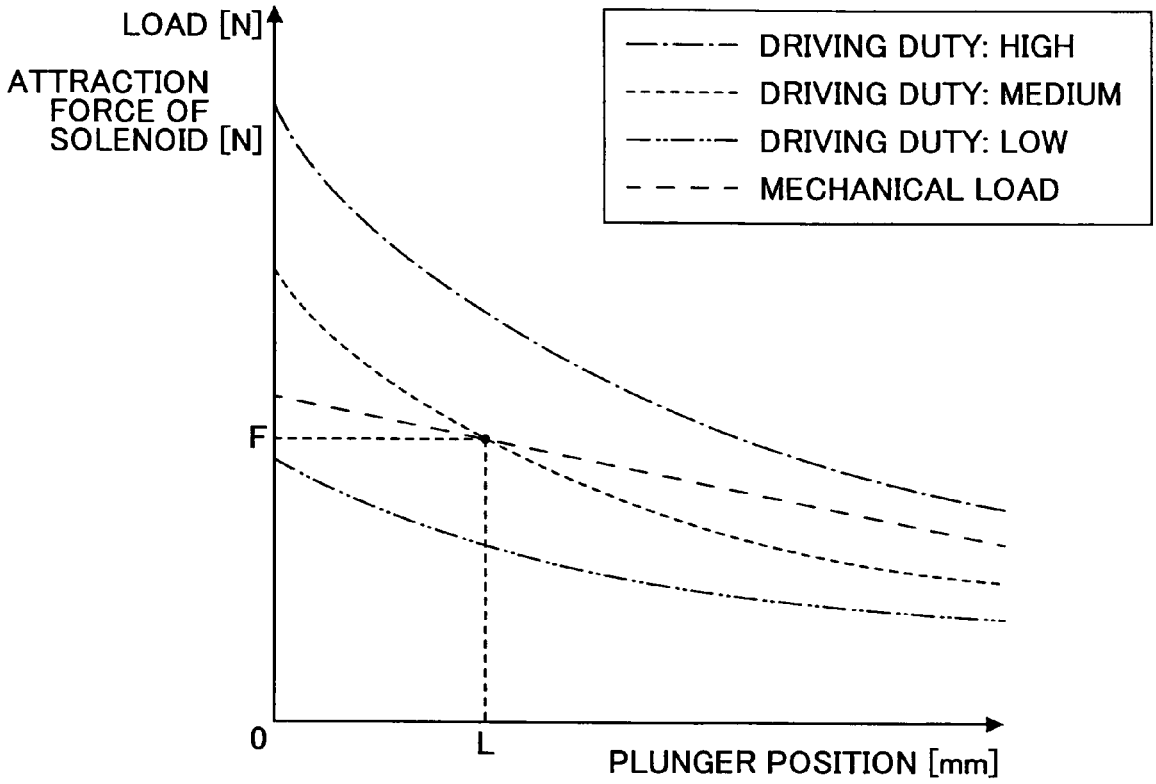
FIG. 5 is a graph showing a relationship between an attraction force of the solenoid device and a mechanical load, and a position of a plunger.

Here, a general relationship between a load (mechanical load) on the connection member connected to the plunger and the coil spring and an attraction force of the solenoid per driving duty ratio is described with reference to a graph in FIG. 5. Note that the driving duty ratio is a value obtained by the following formula: ON time of the current pulse/(ON time of current pulse+OFF time of current pulse). A horizontal axis of the graph shown in FIG. 5 indicates a position of the plunger while a vertical axis indicates an attraction force and a mechanical load of the solenoid.

First, by changing the pulse interval t of the ON/OFF signal inputted to the solenoid, the driving duty ratio is changed. When the driving duty ratio is high, the attraction force of the solenoid is always larger than the mechanical load regardless of a displacement of the plunger. Therefore, the plunger does not extend from the solenoid side. On the other hand, when the driving duty ratio is small, the mechanical load is always larger than the attraction force of the solenoid regardless of the displacement of the plunger. Therefore, the plunger is not attracted into the solenoid side. However, when the driving duty ratio is at a medium value between these driving duty ratios, an attraction force F[N] of the solenoid and a mechanical load are balanced when the plunger is at a position of L [mm]. Thus, with a border of this midpoint, the plunger is either attracted into or extends from the solenoid side.

Figure 1:
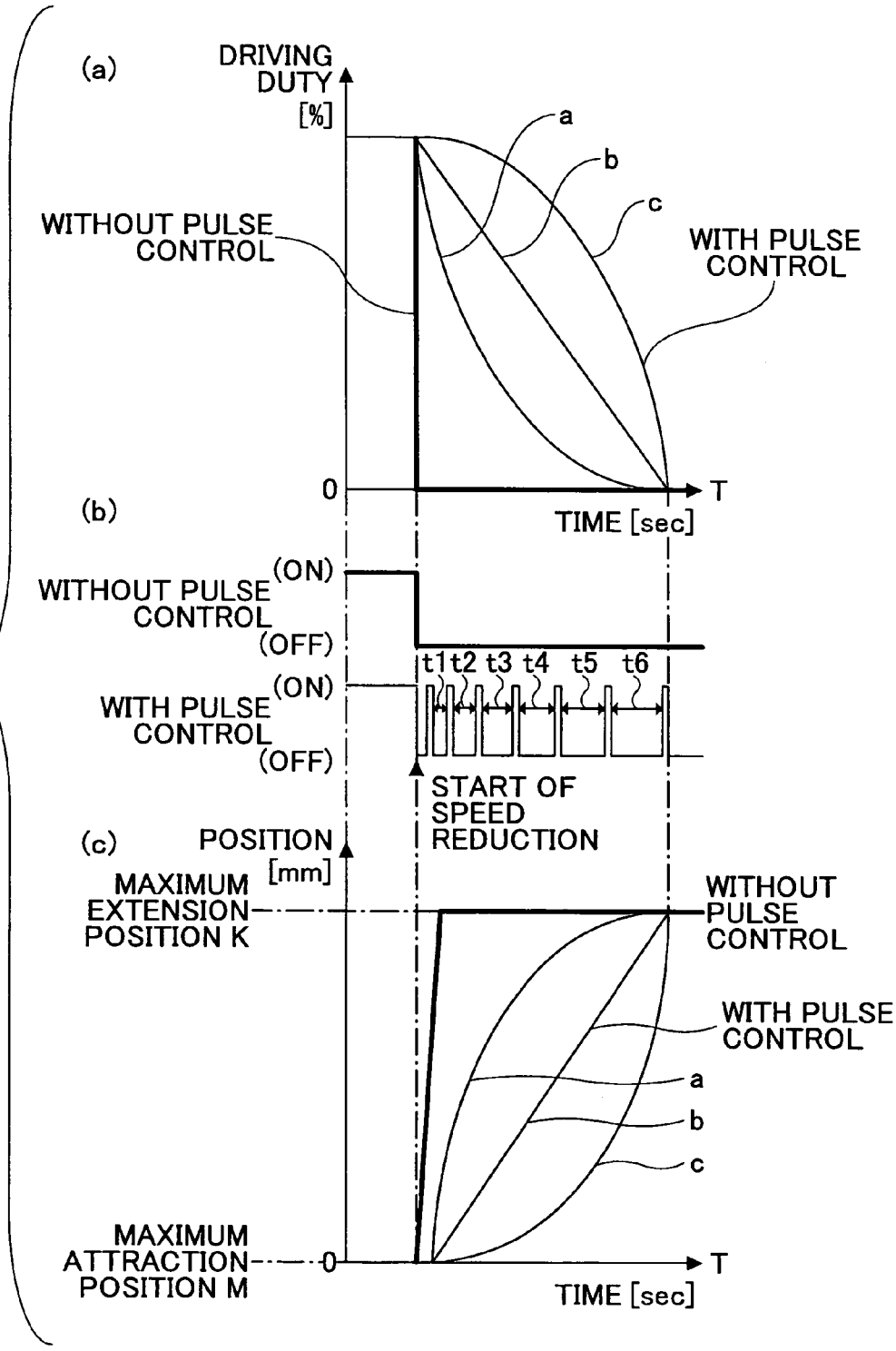
In FIG. 1, part (a) is a graph showing a relationship between a time taken for a plunger of a solenoid device of a first embodiment to move from a maximum attraction position M to a maximum extension position, and a driving duty ratio; part (b) is a graph showing a relationship between a time and a pulse interval; and part (c) is a graph showing a relationship between a time and a position of the plunger.

In this embodiment, as shown in FIG. 1, an ON time of the current pulses supplied to the solenoid 43 is set constant and the interval (pulse interval) t (OFF time of the current pulses) of the current pulses is changed so as to keep the medium driving duty ratio (to keep the midpoint point between the attraction force of the solenoid 43 and the mechanical load), thereby a displacement speed of the plunger 36 is controlled.

That is, in this embodiment, by gradually shortening the pulse interval t (gradually increasing the driving duty ratio) when the plunger 36 is attracted into the solenoid 43 side, the displacement speed of the plunger 36 is reduced. On the other hand, by gradually extending the pulse interval t when the plunger 36 extends from the solenoid 43 side (gradually decreasing the driving duty ratio), the displacement speed of the plunger 36 is decreased. As a result, since the solenoid 43 and the plunger 36, the plunger 36 and the connection member 37, the connection member 37 and the coil spring 38, the connection member 37, the pick-up roller 4, and the holding member 39 hit each other by the displacement of the plunger 36 at a lower speed, an impact noise can be reduced.

Part (a) in FIG. 1 is a graph showing a relationship between a time T taken for the plunger 36 to move from a maximum attraction position M (a position that the plunger 36 is attracted closest to the solenoid 43 side) to a maximum extension position K (a position that the plunger 36 extends furthest from the solenoid 43 side) and a driving duty ratio. Part (b) in FIG. 1 is a graph showing a relationship between the time T and the pulse interval t. It can be seen that the pulse intervals t are gradually longer as in a relationship of $t1<t2<t3<t4<t5<t6$. Part (c) in FIG. 1 is a graph showing a relationship between the time T and a position of the plunger 36. Parts (a) and (b) of FIG. 1 show changes of the driving duty ratio and the position of the plunger 36 with respect to the time T in the case where the interval tables a, b, and c are selected to change the pulse interval t. Note that a relationship between the time T taken for the plunger 36 to move from the maximum extension position K to the maximum attraction position M, and the driving duty ratio and the position of the plunger 36 is similarly shown in the graphs.

In general, the attraction force of the solenoid is known to change due to a cause of an error, such as an applied voltage, winding resistance, ambient temperature, solenoid temperature, a load of a mechanical component connected to the plunger, and the like.

Therefore, the optimal interval table 62 can be selected in accordance with a voltage applied to the solenoid 43 in this embodiment.

For example, when a voltage applied to the solenoid 43 is increased and an attraction force of the solenoid 43 is increased in the case of executing the interval table c, the interval table b or the interval table a with a smaller reduction rate of the pulse interval t than the interval table c is selected instead of the interval table c. As a result, since the driving duty ratio of the solenoid 43 is lowered, the attraction force of the solenoid 43 and the mechanical load can be balanced (the midpoint between the attraction force of the solenoid 43 and the mechanical load can be maintained).

Figure 2:
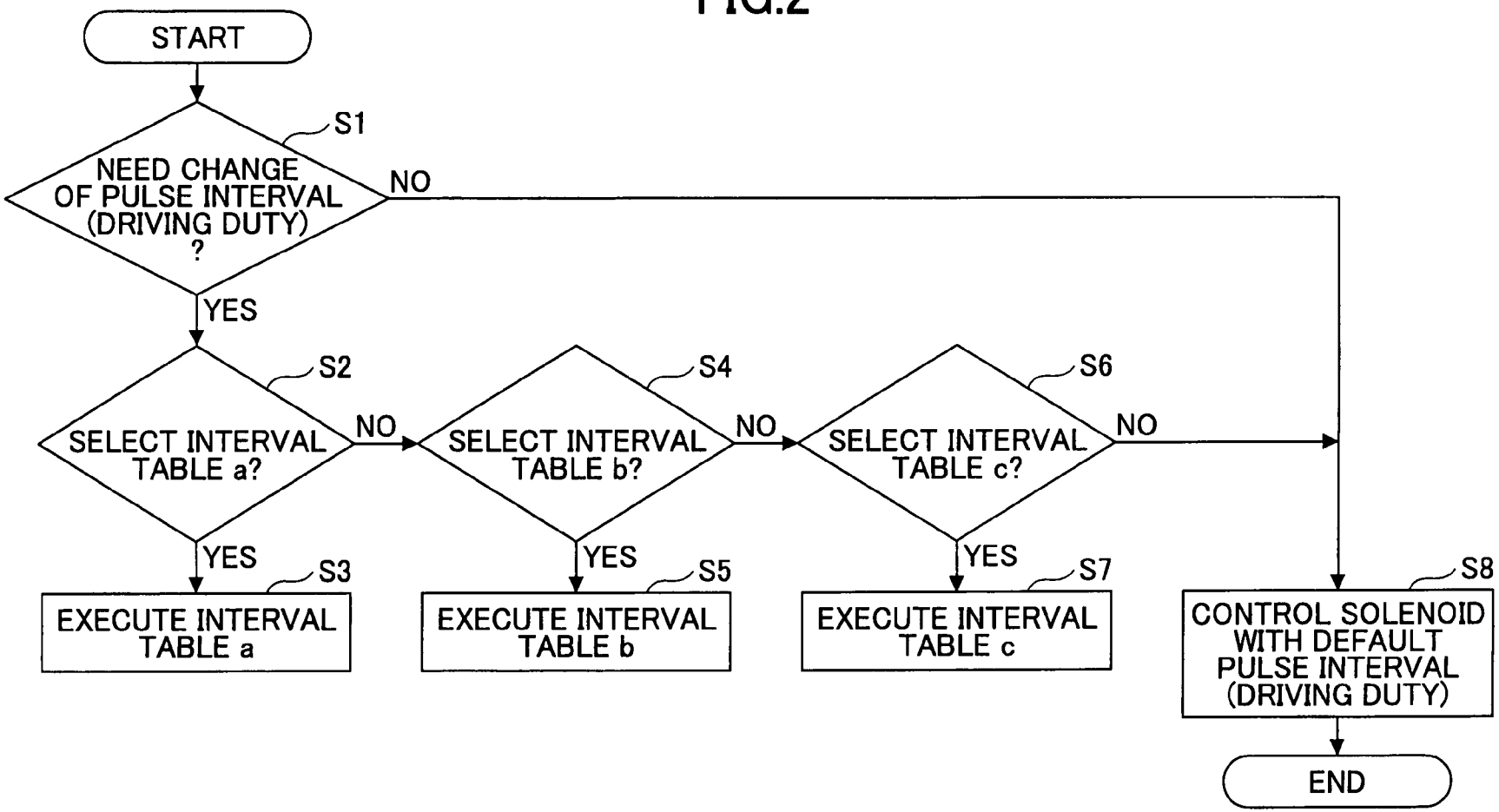
FIG. 2 is a flowchart showing a control flow of selecting an interval table of the solenoid device of the first embodiment.

Hereinafter, a control flow of selecting the interval table 62 of the solenoid device 1 is described with reference to a flowchart shown in FIG. 2. After the interval table selection unit 65 determines that the pulse interval t needs to be changed (YES in S1) in response to the sensor data sent from the voltage sensor 75 and selects the interval table a (YES in S2), the interval table execution unit 67 executes the interval table a (S3). When the interval table selection unit 65 determines that the pulse interval t is not required to be changed (NO in S1), none of the interval tables 62 are executed and a default (initial setting) pulse interval t is executed to control the solenoid 43 (S8). When the interval table b is selected (YES in S4) instead of selecting the interval table a (NO in S2), the interval table b is executed (S5). When the interval table c is selected (YES in S6) instead of selecting the interval table b (NO in S4), the interval table c is executed (S7). When the interval table c is not selected (NO in S6), none of the interval tables 62 are executed and the default (initial setting) pulse interval t is executed to control the solenoid 43 (S8). Although three interval tables 62 are provided here, a similar control flow is employed when two or less and four or more interval tables 62 are provided.

Next, a control flow of executing the selected interval table 62 is described with reference to the flowchart shown in FIG. 3.

Figure 3A:
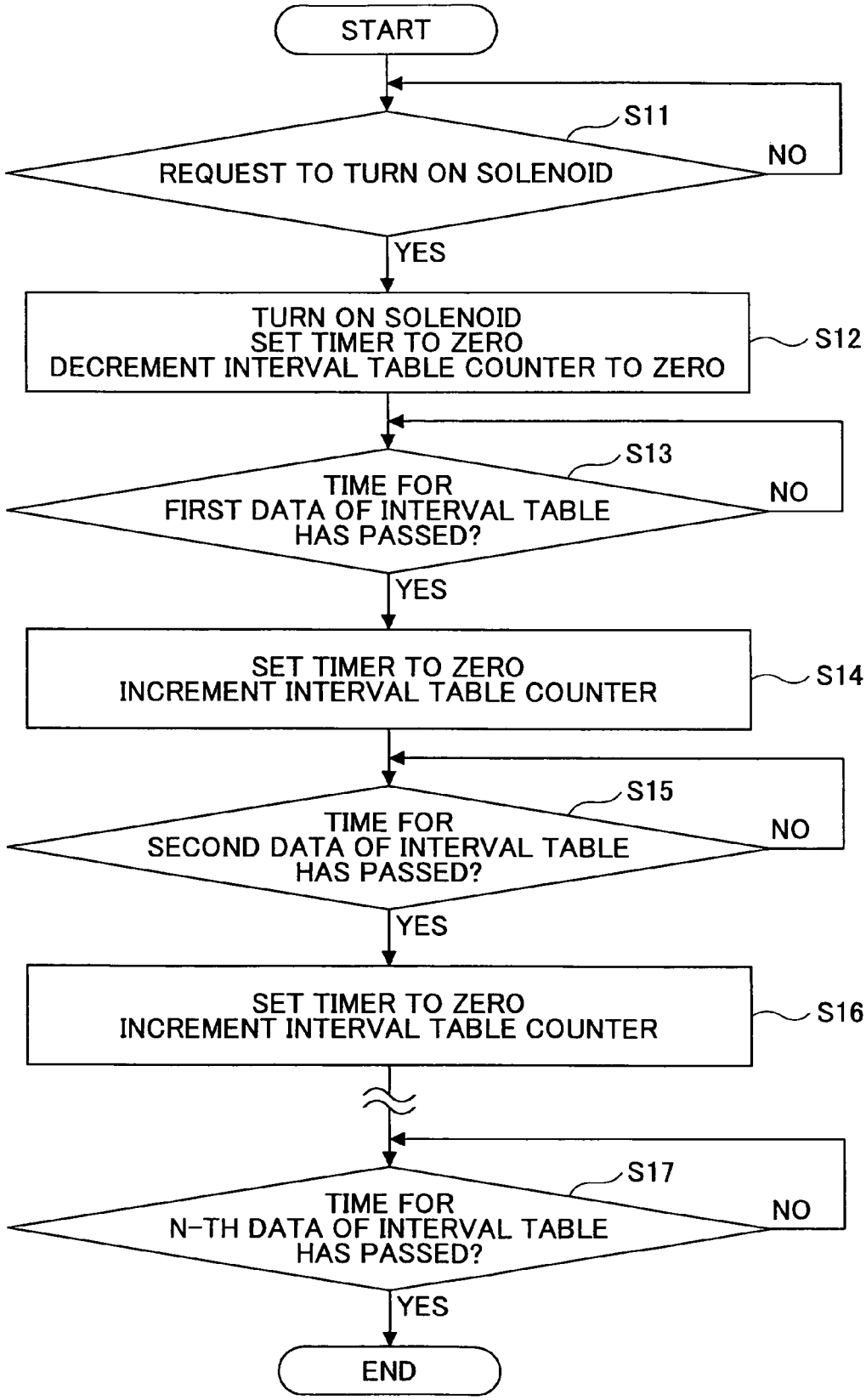
FIGS. 3A and 3B are flowcharts each showing a control flow of executing an interval table of the solenoid device of the first embodiment.

First, a control flow of the case that the plunger 36 is attracted into the solenoid 43 side (the plunger is displaced from the maximum extension position K to the maximum attraction position M) is described with reference to Chart 1 and FIG. 3A. When there is a request to turn ON a supply of current pulses to the solenoid 43, the current flows through the solenoid 43. The timer 69 is reset to zero and an interval table counter is decremented to zero (S12). When first data of the interval table 62 are executed (when a time of the first data (ON time 1+OFF time 1) has passed) (S13), the timer 69 is set zero and the interval table counter is incremented (S14). When second data of the interval table 62 are executed (when time of the second data (ON time 2+OFF time 2) has passed) (S15), the timer 69 is reset to zero and the interval table counter is incremented (S16). Third data and later of the interval table 62 are similarly executed. When N-th data (last data) of the interval table 62 are executed (when time of the N-th data (ON time N+OFF time N) has passed) (S17), the control flow ends.

Figure 3B:
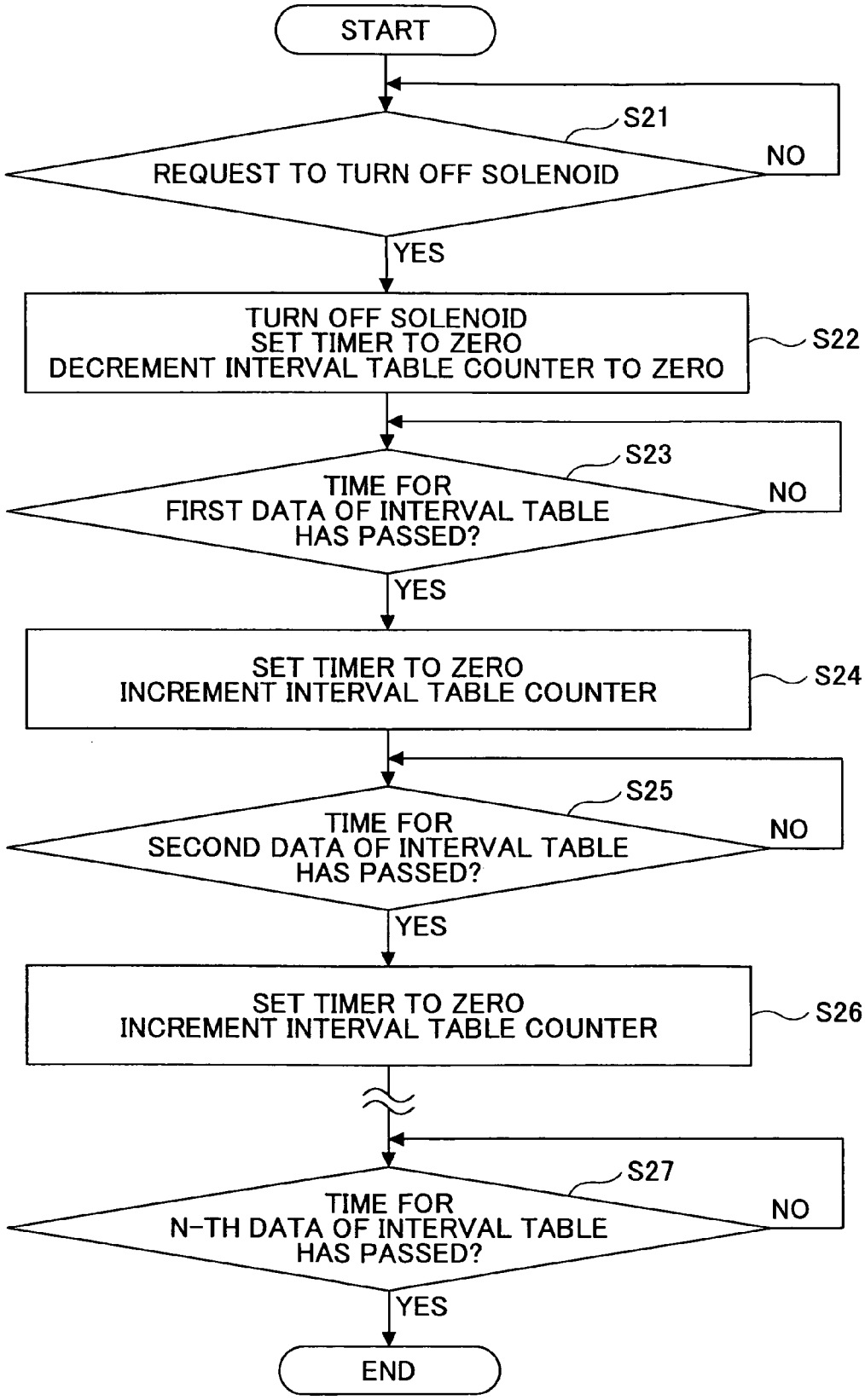

Next, a control flow of the case that the plunger 36 extends from the solenoid 43 side (when the plunger 36 displaces from the maximum attraction position M to the maximum extension position K) is described with reference to FIG. 3B. When there is a request to turn OFF a supply of current pulses to the solenoid 43 (S21), the current supply to the solenoid 43 is stopped, the timer 69 is set zero, and the interval table counter is decremented to zero (S22). When first data of the interval table 62 are executed (when time of the first data (ON time 1+OFF time 1) has passed) (S23), the timer 69 is reset to zero and the interval table counter is incremented (S24). When second data of the interval table 62 are executed (when time of the second data (ON time 2+OFF time 2) has passed) (S25), the timer 69 is reset to zero and the interval table counter is incremented (S26). Third data and later of the interval table 62 are similarly executed. When N-th data (last data) of the interval table 62 are executed (when time of the N-th data (ON time N+OFF time N) has passed) (S27), the control flow ends.

Hereinafter, an operational effect of this embodiment is described. According to this embodiment, an impact noise caused by the displacement of the plunger 36 can be sufficiently reduced by supplying current pulses to the solenoid 43 and changing the pulse interval t, without providing an electric circuit control element and the like such as a pulsed current supply driver. Therefore, the impact noise caused by the displacement of the plunger 36 can be sufficiently reduced with a simple structure at lower cost. Further, for example, by appropriately changing a change rate of the interval of the current pulses supplied to the solenoid 43, an impact noise made by the displacement of the plunger 36 can be sufficiently reduced even when an operation environment changes or a mechanical load on the plunger 36 varies.

By gradually shortening the intervals of the current pulses supplied to the solenoid 43, an impact noise caused when the plunger 36 is attracted to the solenoid 43 side can be reduced.

By gradually extending the intervals of the current pulses supplied to the solenoid 43, an impact noise caused when the plunger 36 extends from the solenoid 43 can be reduced.

As the interval t of the current pulses supplied to the solenoid 43 can be changed in accordance with a voltage applied to the solenoid 43, the solenoid 43 can be driven with an optimal pulse interval t in accordance with the voltage applied to the solenoid 43. Therefore, a silencing effect can be provided in accordance with a change of the voltage applied to the solenoid 43.

An automatic document feeder 32 having the solenoid device 1 with a similar effect to that of this embodiment can be provided.

An image forming apparatus 50 having the automatic document feeder 32 with a similar effect to that of this embodiment can be provided.

Hereinafter, another embodiment of the invention is described. In the following description, components having the same effects to those in the first embodiment are denoted by the same reference numerals and detailed description thereof will be omitted. Different aspects from the first embodiment will be described below.

Figure 10A:
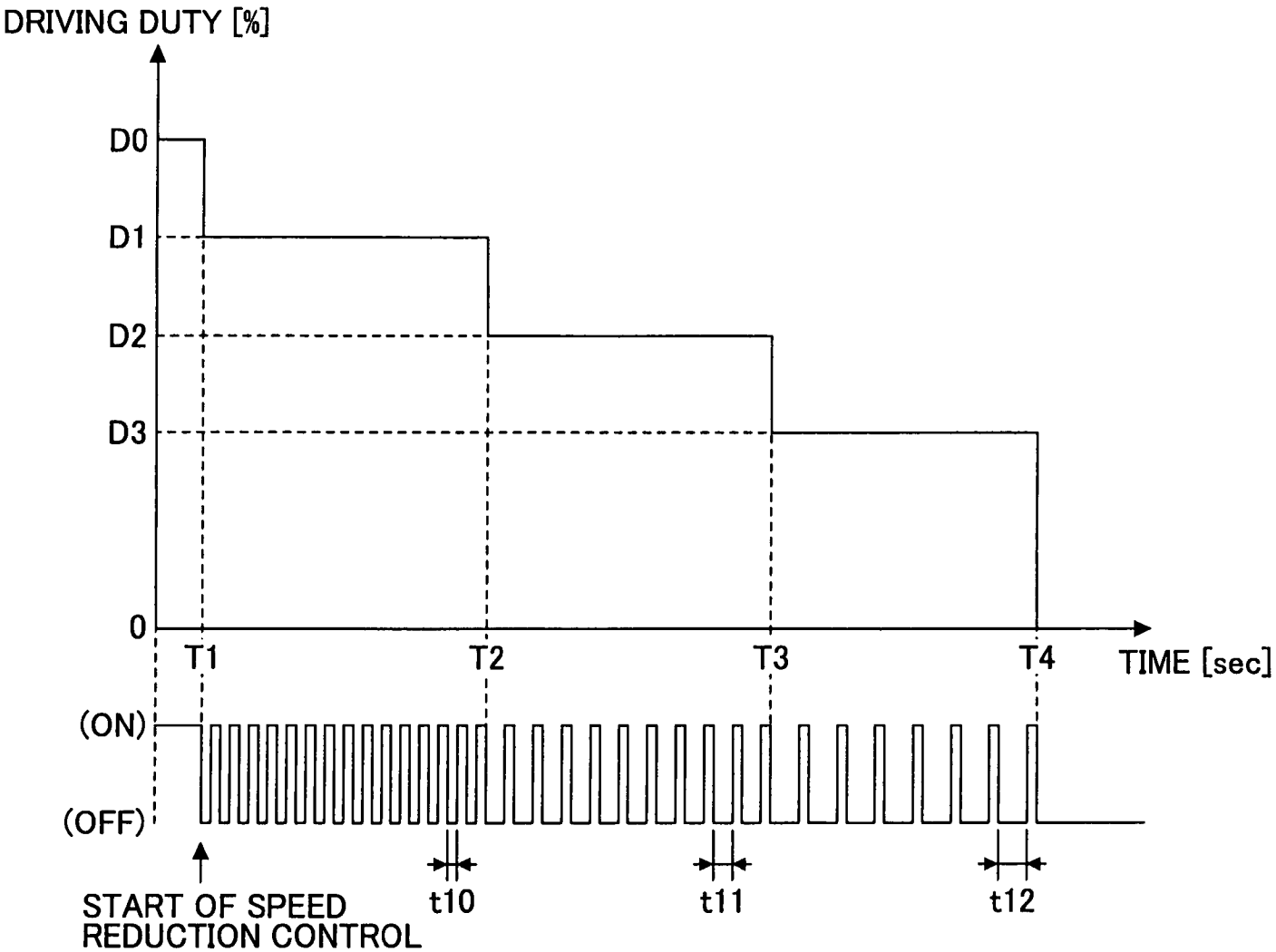
FIG. 10A is a graph showing a change of a pulse interval of a solenoid device of a second embodiment when the plunger extends from a solenoid side.

Hereinafter, a second embodiment is described with reference to FIGS. 10A and 10B. When the plunger 36 extends from the solenoid 43 side, as shown in FIG. 10A, the driving control unit 57 has plural pulse groups each formed of plural pulses with a constant pulse interval t (constant driving duty ratio). The pulse intervals t are set to be gradually longer per group. During a time between T1 and T2, there is a pulse group with a constant pulse interval t10. In a time between T2 and T3, there is a pulse group with constant pulse interval t11. In a time between T3 and T4, there is a pulse group with a constant pulse interval t12. In this manner, the pulse intervals are gradually longer per pulse group (t10<t11<t12).

Figure 10B:
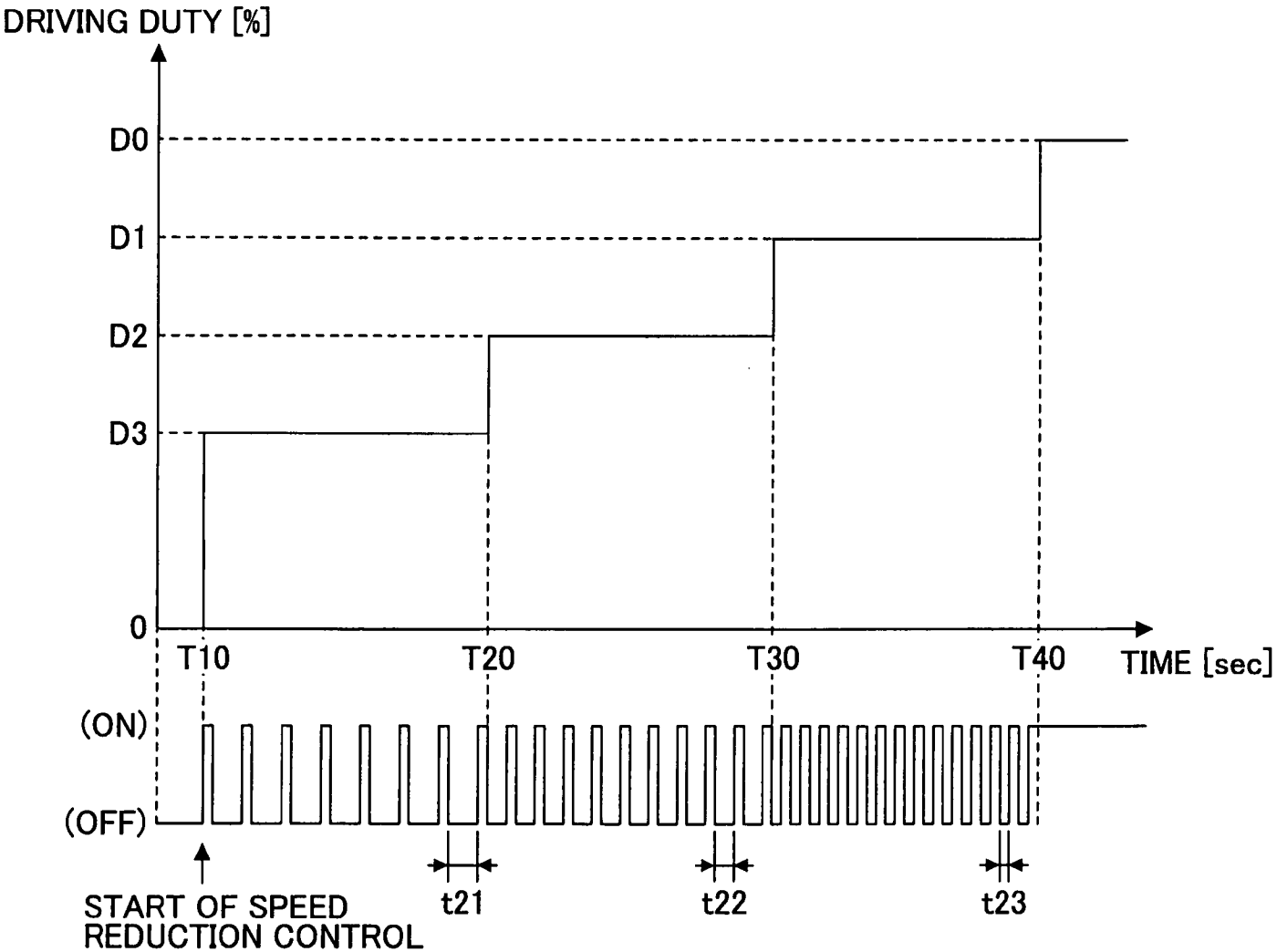
FIG. 10B is a graph showing a change of a pulse interval of the solenoid device of the second embodiment when the plunger is attracted to the solenoid side.

Further, when the plunger 36 is attracted into the solenoid 43 side, as shown in FIG. 10B, the driving control unit 57 includes plural pulse groups formed of plural pulses with a constant pulse interval t (constant driving duty ratio). The pulse intervals t are set to be gradually shorter per group. In a time between T10 and T20, there is a pulse group with a constant pulse interval t21. In a time between T20 and T30, there is a pulse group with a constant pulse interval t22. In a time between T30 and T40, there is a pulse group with a constant pulse interval t23. In this manner, the pulse intervals are gradually shorter per pulse group (t21>t22>t23).

According to this embodiment, there are provided plural pulse groups formed of plural pulses with a constant pulse interval t. Since the pulse interval t is changed per pulse group, the plunger 36 is displaced while setting a long time to keep the driving duty ratio constant (setting a long time when the attraction force of the solenoid 43 and the elastic force of the coil spring 38 are balanced). As a result, an impact noise caused by the displacement of the plunger 36 can be surely reduced. Therefore, even when a temperature of the solenoid 43 itself is raised when driven and the attraction force of the solenoid 43 is reduced, an impact noise caused by the displacement of the plunger 36 can be reduced.

An automatic document feeder 32 having the solenoid device 1 with a similar effect to this embodiment can be provided.

An image forming apparatus 50 having the automatic document feeder 32 with a similar effect to this embodiment can be provided.

Figure 11:
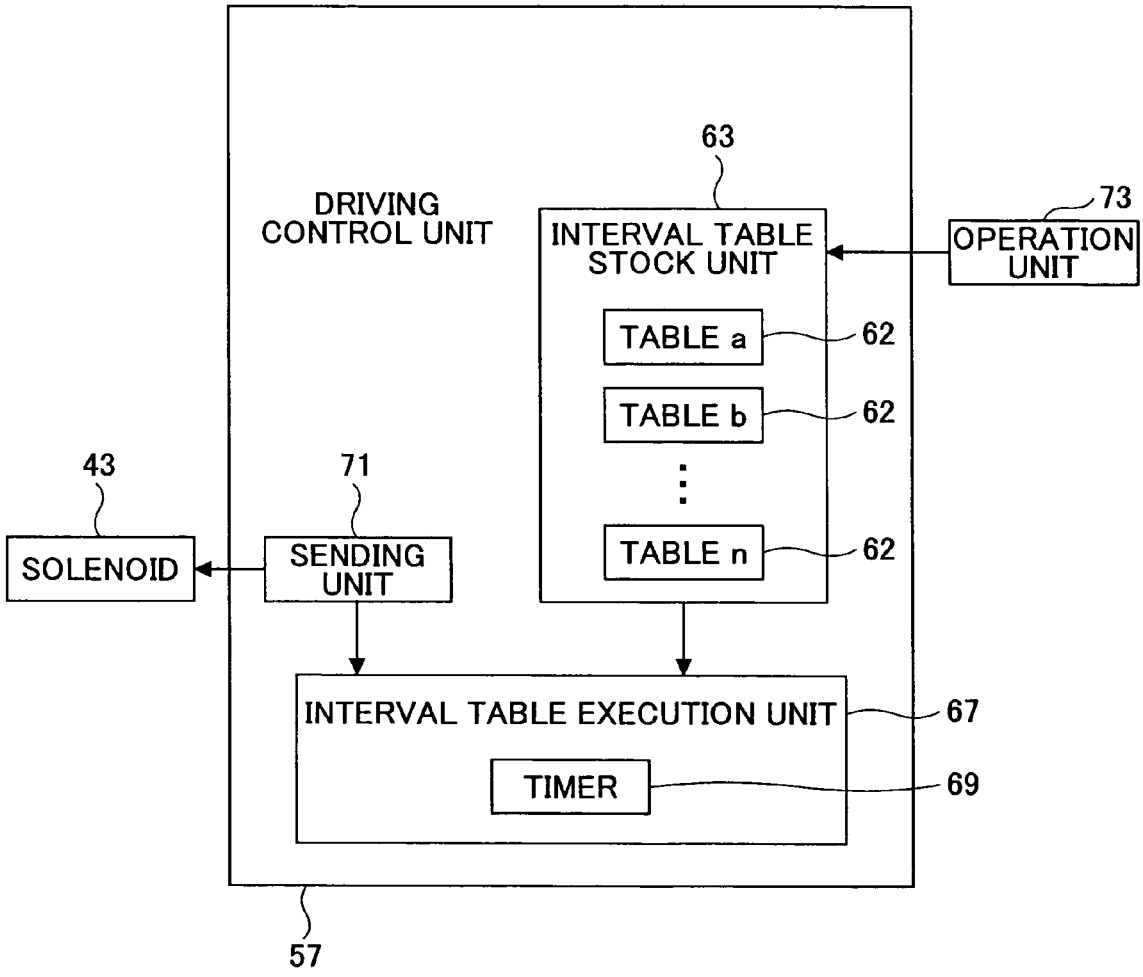
FIG. 11 is a block diagram showing a configuration of a driving control unit of a solenoid device of a third embodiment.
Figure 12:
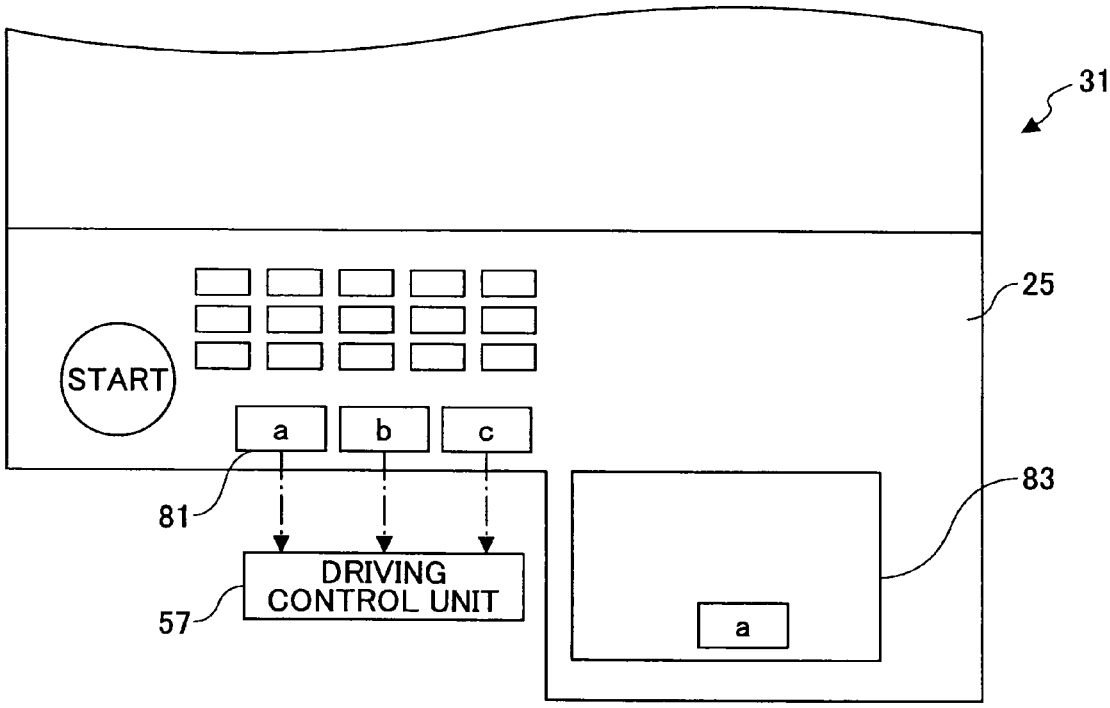
FIG. 12 is a schematic plan view showing an operation panel of an image forming apparatus of the third embodiment.

Hereinafter, a third embodiment is described with reference to FIGS. 11 and 12. In this embodiment, the voltage sensor 75 is not provided. Moreover, the interval table selection unit 65 is not provided in the driving control unit 57 as shown in FIG. 11. The interval table 62 (any one of the interval tables a, b, and c in this embodiment) can be selected by pressing an interval table selection button 81 (see FIG. 12) of an operation panel 25 (see FIGS. 9 and 12) of the image forming apparatus body 31. Then, the selected interval table is displayed on an operation display 83 (for example, "a" is displayed when the interval table a is selected).

That is, by sending a selection signal from the operation unit 73 in the image forming apparatus body 31 to the interval table storage unit 63, an execution signal is sent through the sending unit 71 to the solenoid 43, whereby the interval table execution unit 67 executes the selected interval table. When none of the interval tables 62 are selected, the solenoid 43 is controlled by a default (initial setting) pulse interval t.

According to this embodiment, in accordance with conditions of the apparatus such as when components are not warmed up enough right after the apparatus is set or when the components are warmed up after the apparatus is well used, the appropriate interval table 62 can be selected as desired by a user or a service person. Therefore, an impact noise can be sufficiently reduced in accordance with a mechanical change of the apparatus.

An automatic document feeder 32 having the solenoid device 1 with a similar effect to this embodiment can be provided.

An image forming apparatus 50 having the automatic document feeder 32 with a similar effect to this embodiment can be provided.

The present invention is not limited to the aforementioned embodiments and can be variously changed within the scope of the claims.

In the aforementioned embodiments, the plunger 36 is biased from the maximum attraction position M to the maximum extension position K (a direction extending from the solenoid 43) by providing the coil spring (biasing member) 38. However, the solenoid 43 may attract the plunger 36 from a lower side to an upper side (resisting a gravity on the plunger 36) and the plunger 36 may extend from the solenoid 43 by moving from the maximum attraction position M to the maximum extension position K by the plunger 36's own weight.

In the aforementioned embodiments, the solenoid device 1 is used as a unit to move the pick-up roller (moving member) 4, however, the solenoid device 1 may be used as a unit to move the switching claw (moving member) 14 as well.

In the aforementioned embodiment, the interval table 62 is selected and executed, however, data of a change rate of the pulse interval t may be inputted to the driving control unit 57 in advance to change the change rate of the pulse interval t. In this case, the change rate of the pulse interval t is preferably changed by operating the operation panel 25 or the like of the image forming apparatus body 31.

In the first and second embodiments, the voltage sensor 75 is provided to change the pulse interval t in accordance with a voltage applied to the solenoid 43, however, a temperature sensor 77 capable of sensing a temperature of the solenoid 43 may be provided in the solenoid unit 35 instead of or in addition to the voltage sensor 75. As a result, the interval table 62 can be selected in accordance with the temperature of the solenoid 43. In this case, a content of the interval table 62 may be changed or the interval table storage unit 63 may be added as required.

In the first and second embodiments, the voltage sensor 75 is provided to change the pulse interval t in accordance with a voltage applied to the solenoid 43, however, a load sensor 79 capable of sensing an elastic force (load applied to the plunger 36) of the coil spring (biasing member) 38 may be provided at one end (end attached to the connection member 37) of the coil spring 38. As a result, the interval table 62 can be selected in accordance with a change of the elastic force (load variation) of the coil spring 38. In this case, a content of the interval table 62 may be changed or the interval table storage unit 63 may be added as required.

The automatic document feeder 32 of the aforementioned embodiments is provided in a multifunction peripheral, however, the automatic document feeder 32 may be provided in an image forming apparatus such as a facsimile machine.

This patent application is based on Japanese Priority Patent Application No. 2007-326491 filed on Dec. 18, 2007, the entire contents of which are hereby incorporated herein by reference.

What is claimed is:

1. A solenoid device comprising:

a plunger;

a solenoid configured to cause a displacement of the plunger; and a driving control unit configured to control driving of the solenoid, wherein the driving control unit is configured to supply current pulses to the solenoid and change a pulse interval of the current pulses, configured to select a table from a plurality of interval tables having different pulse intervals from each other, and supply the current pulses to the solenoid according to the selected table, and configured to set the pulse interval to be gradually shorter when the plunger is attracted to the solenoid and wherein the driving control unit includes a voltage sensor configured to sense a voltage applied to the solenoid and changes the pulse interval in accordance with the voltage applied to the solenoid.

2. The solenoid device as claimed in claim 1, wherein the driving control unit sets the pulse interval to be gradually longer when the plunger moves away from the solenoid.

3. The solenoid device as claimed in claim 1, wherein pulse groups each formed of plural pulses having a constant pulse interval are defined; and the driving control unit supplies to the solenoid the plural pulses of a given pulse group followed by the plural pulses of a next pulse group in a sequence of the pulse groups such that the constant pulse interval decreases from pulse group to pulse group when the plunger is attracted to the solenoid.

4. The solenoid device as claimed in claim 1, wherein pulse groups each formed of plural pulses having a constant pulse interval are defined; and the driving control unit supplies to the solenoid the plural pulses of a given pulse group followed by the plural pulses of a next pulse group in a sequence of the pulse groups such that the constant pulse interval increases from pulse group to pulse group when the plunger moves away from the solenoid.

5. A solenoid device comprising:

a plunger;

a solenoid configured to cause a displacement of the plunger; and a driving control unit configured to control driving of the solenoid, wherein the driving control unit is configured to supply current pulses to the solenoid and change a pulse interval of the current pulses, configured to select a table from a plurality of interval tables having different pulse intervals from each other, and supply the current pulses to the solenoid according to the selected table, and configured to set the pulse interval to be gradually shorter when the plunger is attracted to the solenoid and wherein the driving control unit includes a temperature sensor configured to sense a temperature of the solenoid and changes the pulse interval in accordance with the temperature of the solenoid.

6. A solenoid device comprising:

a plunger;

a solenoid configured to cause a displacement of the plunger;

a biasing member configured to bias the plunger in a direction extending away from a solenoid housing; and a driving control unit configured to control driving of the solenoid, wherein the driving control unit is configured to supply current pulses to the solenoid and change a pulse interval of the current pulses, and the driving control unit includes a load sensor configured to sense a load applied by the biasing member onto the plunger and change the pulse interval in accordance with the sensed load.

* * * * *